United States Patent [19]

Abbe

[11] Patent Number: 4,872,802

[45] Date of Patent: Oct. 10, 1989

[54] APPARATUS AND METHOD FOR REMOVING THE CONTENTS OF A CAN

[76] Inventor: Ross E. Abbe, 2721 Victor St., Bellingham, Wash. 98225

[21] Appl. No.: 67,931

[22] Filed: Jun. 29, 1987

[51] Int. Cl.[4] ..... B65B 69/00

[52] U.S. Cl. ..... 414/417; 414/786; 222/82; 222/80; 222/633; 222/570

[58] Field of Search ..... 414/416, 417, 411, 412, 414/403, 404; 221/278; 222/82, 631, 632, 633, 570

[56] References Cited

U.S. PATENT DOCUMENTS

| | | | |
|---|---|---|---|
| 1,400,162 | 12/1921 | Holmes | 222/633 |
| 2,690,850 | 10/1954 | Welker | 414/417 X |
| 2,776,782 | 1/1957 | Hope | 222/82 |
| 3,228,564 | 1/1966 | Olson | 222/82 |
| 3,477,597 | 11/1969 | Benner, Sr. | 414/417 X |
| 4,706,849 | 11/1987 | Ryan | 222/80 |

FOREIGN PATENT DOCUMENTS

| | | | |
|---|---|---|---|
| 1150184 | 6/1963 | Fed. Rep. of Germany | 414/417 |
| 2151593 | 4/1972 | Fed. Rep. of Germany | 222/570 |
| 754739 | 11/1933 | France | 222/88 |

*Primary Examiner*—Frank E. Werner

*Attorney, Agent, or Firm*—Hughes & Multer

[57] ABSTRACT

An apparatus for removing the contents of a can which uses a conventional can opener having a triangularly shaped outside edge forward portion for opening a can. Positioned on the front of the can opener near the outside edge is an opening air sealing device whereby as the outside edge forward portion makes an opening in the can the opening air sealing device closes the opening. An air pressurizing device in the form of a squeeze bulb and a conduit defining a passageway are attached to the can opener and the conduit defining a passageway is positioned through the opening air sealing device at one end of the air pressurizing device and the conduit is connected to the squeeze bulb at the other end of the air pressurizing device. After the top of the can is removed, the apparatus is pressed downwardly onto the bottom of the can thereby making a hole in the bottom of the can, the hole being sealed by the opening air sealing device such that the conduit extends through the opening air sealing device into the inside of the can. Air is pressurized in the can by the air pressurizing device and flows through the conduit into the bottom of the can thereby forcing the contents of the can to be pushed out through the top of the can.

12 Claims, 3 Drawing Sheets

APPARATUS AND METHOD FOR REMOVING THE CONTENTS OF A CAN

BACKGROUND OF THE INVENTION

1. Field of the Invention

The present invention relates generally to an apparatus for removing the contents of a can and, in particular, to a novel implement which can conveniently be used in a totally manual operation.

2. Background Art

The problem of removing semi-solid or solid contents from a can has long been known and has been a nuisance to millions of people over the years. As an example, removing frozen orange juice concentrate from an orange juice can, usually requires digging the contents out of the can and has proven unsatisfactory because it is messy and usually does not remove the entire contents of the can. Previous methods and devices used to remove the contents of a can have been complicated and expensive and have not really addressed the problem.

A search of the U.S. patent literature has disclosed a number of prior art patents, these being as follows:

U.S. Pat. No. 3,477,596 to Benner, Sr. discloses a device for forcing a cooked product from a can which is sealed with a tear strip. After the tear strip is removed, air is injected into the can by a can puncturing air needle which forces the contents from the can.

U.S. Pat. No. 2,984,375 to Gardner discloses a device for removing the contents of a can wherein there is a can end removing means which slices the end of the can off. An air injector means punches through the upper can and forces air into the can to remove the contents.

U.S. Pat. No. 2,946,470 to McFarland teaches a device for removing the cover and contents of a can The contents of the can are removed by a pistonlike element rather than directly applied air pressure.

U.S. Pat. No. 2,795,344 to Lubischer shows a machine which removes the contents of a can wherein the can is closed at each end by metal plates that are removed by the machine and the contents are forced out by air.

U.S. Pat. No. 2,690,850 to Welker discloses one embodiment in which air is forced into the closed end of a drum so that the contents are forced out of the open end and another embodiment in which air is supplied through a tube which is forced through the contents so that air is discharged at the closed end of the container.

U.S. Pat. No. 1,221,321 to Hendler shows the use of compressed air to force ice cream from a mold.

The above cited patents, while undoubtedly satisfactory for there intended purpose, do not disclose the concept of an opening device which used one opening motion to make an opening in the can and shortly thereafter seals the opening by continuing the motion, and this being followed by a pumping action to eject the contents from the can. In addition, the above-mentioned references are substantilly more complicated in use and design, and some relatively complex apparatus.

SUMMARY OF THE INVENTION

In order to overcome problems inherent in the before-described devices, machines and methods of removing the contents of a can, there is taught in the present invention a new and novel apparatus for removing the contents of a can which comprises a can opening means wherein an opening air sealing means is provided to close the opening made in the can by the can opening means and an air pressurizing means is attached to the can opening means whereby after the top of a can is removed, the apparatus is pressed downwardly onto the bottom fo the can thereby making a hole in the bottom of the can and the hole is sealed by the opening air seal means. Part of the air pressurizing means extends through the opening air sealing means into the inside of the can and air is driven from the air pressurizing means into the bottom of the can, thereby forcing the contents of the can to be pushed out through the top of the can. One advantage of the present invention is that the can opening means can be in a form similar to a conventional beverage can opener having a triangularly shaped forward portion which punctures a triangularly shaped hole in a can. Within the broader aspects of the present invention, other hole forming means could be provided.

A method is also disclosed of removing the contents of a can wherein the can has an open end and contents. The method comprises the steps of providing a handle with a gripping portion adapted to be grasped manually, providing a can opening means mounted to the handle, positioning the can opening means to form an opening in the can by manipulation of the handle, providing an opening air sealing means also mounted to the handle and positioning the opening air sealing means to be moved into sealing engagement with the can by manipulation of the handle to enclose the opening. An air pressurizing means which is mounted to the handle is also provided, the handle is grasped, positioned in gripping engagement with the can and the handle is manipulated to form a hole in the can, the hole being sealed by the air sealing means and pressurized air is injected through the air sealing means to pressurize an interior area of the can, and thereby forcing the contents of the can to be pushed out of the open end of the can.

Accordingly, it is an object and advantage of the invention to provide a new and improved implement for removing the contents of a can which is simple to manufacture and use.

Another object and advantage of the invention is to provide an implement for removing the contents of a can which is inexpensive and compact.

Yet another object and advantage of the invention is to provide an efficient method of removing the contents of a can which requires a simple manual operation on the part of the user.

Still yet another object and advantage of the invention is to provide a method for removing the contents of a can which is clean and convenient to use.

These and other object and advantages of the invention will become apparent from a review of the drawings and from a study of the hereinafter description of the preferred embodiment which is given by way of illustration only.

DESCRIPTION OF THE PREFERRED EMBODIMENT

Figure 1:
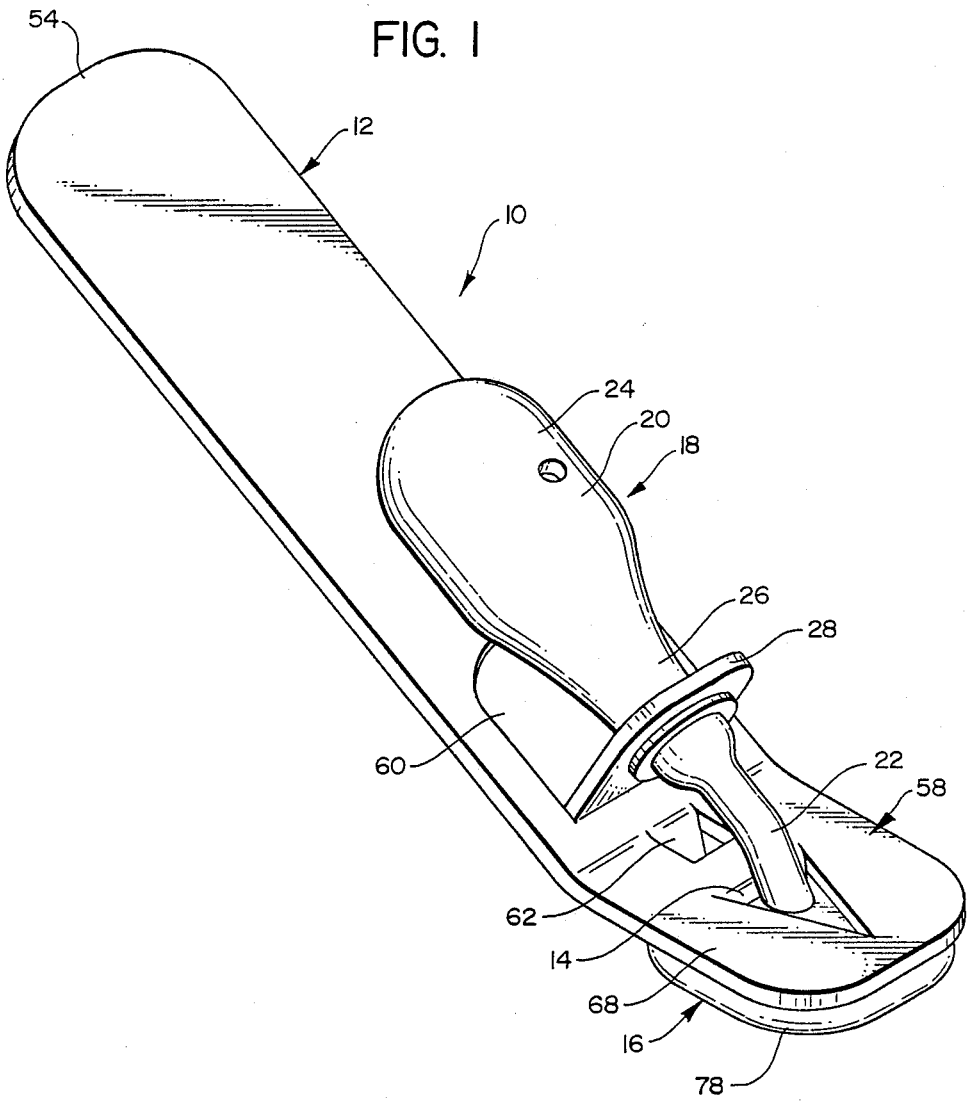
FIG. 1 is a top persepective view of the implement for removing the contents of a can.

Referring now to the drawings in general and in particular to FIG. 1 of the drawings, there is shown a top perspective view of the implement for removing the contents of a can indicated generally by the numeral 10 having a handle 12 which is adapted to be grasped manually and a can opening means 14 which is mounted to the handle 12, with the can opening means 14 being positioned to form an opening in a can by a manipulation of handle 12. In the preferred form, the handle 12 and the can opening means 14 are similar in configuration to a conventional opener for opening a beverage can, where there is a handle and a triangularly shaped forward portion which punctures a triangularly shaped hole in a can.

In addition, the present invention has an opening air sealing means 16 also mounted to the handle 12 and positioned to be moved into sealing engagement with a can by manipulation of the handle 12 so as to close the opening in the can made by the can opening means 14. There is also provided an air pressurizing means 18 mounted to the handle 12 which injects air through the opening air sealing means 16 to pressurize an interior area of the can. In the preferred form, this air pressurizing means 18 comprises a squeeze bulb 20 and an air conduit 22 which defines an air passageway 23 and leads through the sealing means 16 to direct air into the can.

The squeeze bulb 20 has a main body portion 24 defining an air chamber 25 and a forward mounting end 26 by which the squeeze bulb 20 is attached to an upstanding mounting plate or tab 28 formed from, and extending upwardly from, the handle 12. The lower surface 30 of the main body portion 24 of this squeeze bulb 20 rests upon an upper surface 32 of the handle 12. A through opening 34 is formed at the upper surface 36 of the squeeze bulb, and this opening 34, communicating with the air chamber 25, is positioned so that when a person grasps the handle 10 in the person's fingers, the thumb of the hand (indicated at 37 in FIG. 4) is positioned immediately over the opening 34.

The air conduit 22 has a front air discharge end 38 and a rear mounting portion 40. The forward discharge end 38 extends through the sealing means 16, while the rear mounting end 40 connects to the aforementioned mounting plate 28. More specifically, the rear mounting end 40 has a moderately expanded configuration indicated at 41 to join to a circumferential mounting device comprising a pair of circumferential lips 42 defining a groove 44 which fits into a circular opening 46 formed in the mounting plate 28. It is to be understood that the bulb 20 could be mounted in some other manner. For example, the bulb 20 could be mounted directly to the plate portion 68 which is described hereinafter.

Figure 3:
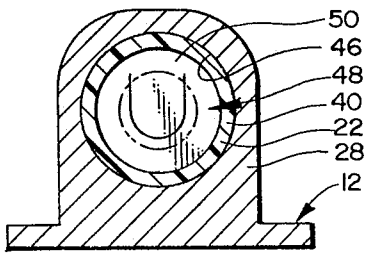
FIG. 3 is a cross-sectional view taken through line 3—3 of FIG. 2 showing the opening between the squeeze bulb and the tube.

Positioned within the mounting plate 28 between the air chamber 25 and the air passageway 23 is a check valve 48. As shown in FIG. 3, this check valve 48 comprises a peripheral mounting portion 50 that is held in place between the front edge of the forward mounting end 26 of the squeeze bulb 20 and an annular shoulder formed at the rear mounting end 40 of the conduit 22. The check valve 48 further comprises a flap member 52 arranged to open in a forward direction to permit air to flow from the air chamber 25 into the air passageway 23, but to prevent reverse flow.

The handle 12 is in the preferred configuration made from a piece of flat metal plate stock so that the handle 12 itself has a flat plate-like configuration. One of the desirable features of the preferred embodiment of the present invention is that it is arranged so that the can opening means 14, the mounting plate 28 and a part of the sealing means 16 can be formed as part of the same flat metal stock from which the handle 12 is formed. This particular facet of the present invention will be described in more detail later herein.

As indicated previously, this handle 12 is, or may be, formed as the handle of a conventional beverage can opener, having a rear end 54, the aforementioned upper surface 32, a lower surface 56, and a forward operating end 58 to which the can opening means 14 and the sealing means 16 are mounted. It will be noted that the mounting plate or tab 28 is formed by deforming a forward part of the handle 12 upwardly, leaving an open area 60 at the forward end 58 of the handle 12.

To describe the can opening means 14 more particularly, there is formed at the forward end of the handle 12 a short forwardly and downwardly extending finger 62 which is arranged to engage a lower surface of a peripheral edge or lip 64 of a can, indicated at 66.

The can opening means 14 further comprises an upwardly and forwardly extending plate portion 68 from which is formed a forwardly and downwardly extending triangular cutting member 70. This cutting member 70 is or may be formed in the configuration of the opening portion of a conventional beverage can opener, and as shown herein, the member 70 has a sharp apex end 72 to make an initial puncture in a bottom closure plate 74 of the can 66. This cutting member 70 has two cutting edges 76 extending rearwardly and outwardly from the apex end 72. Thus, this triangular cutting member 70 forms in the bottom plate or lid portion 74 a triangular opening or cut-out, much in the fashion of a conventional beverage can opener.

To describe the sealing means 16 in more detail, the aforementioned forward plate portion 68 serves as a base plate for the sealing means 16. Mounted to the plate portion 68 is a sealing portion 78 made of an air impervious flexible material which extends across the entire surface of the plate portion 68. The air discharge end 38 of the conduit 22 and the cutting member 70 extend through the sealing portion 78, with the sealing portion 78 fitting snugly against the cutting member 70 and the conduit end 38 to provide an air tight seal. Further, in the position of FIG. 4 the peripheral portions of the sealing portion 78 become positioned around the cutout or opening formed by the cutting member 70 so that when the sealing portion 78 engages the bottom plate or lid 74, the opening formed by the cutting member 70 is totally sealed.

It was indicated previously that one of the desirable features of the present invention is that much of this device 10 can be formed from a single piece of flat metal stock. From the above description, it can be seen that this is accomplished by forming the aforementioned mounting plate 28, the finger 62 and the triangular cutting member 70 from the initial flat plate stock. Further, the plate portion 68 is provided by deforming the forward end of the plate metal stock upwardly at a moderate angle.

Figure 2:
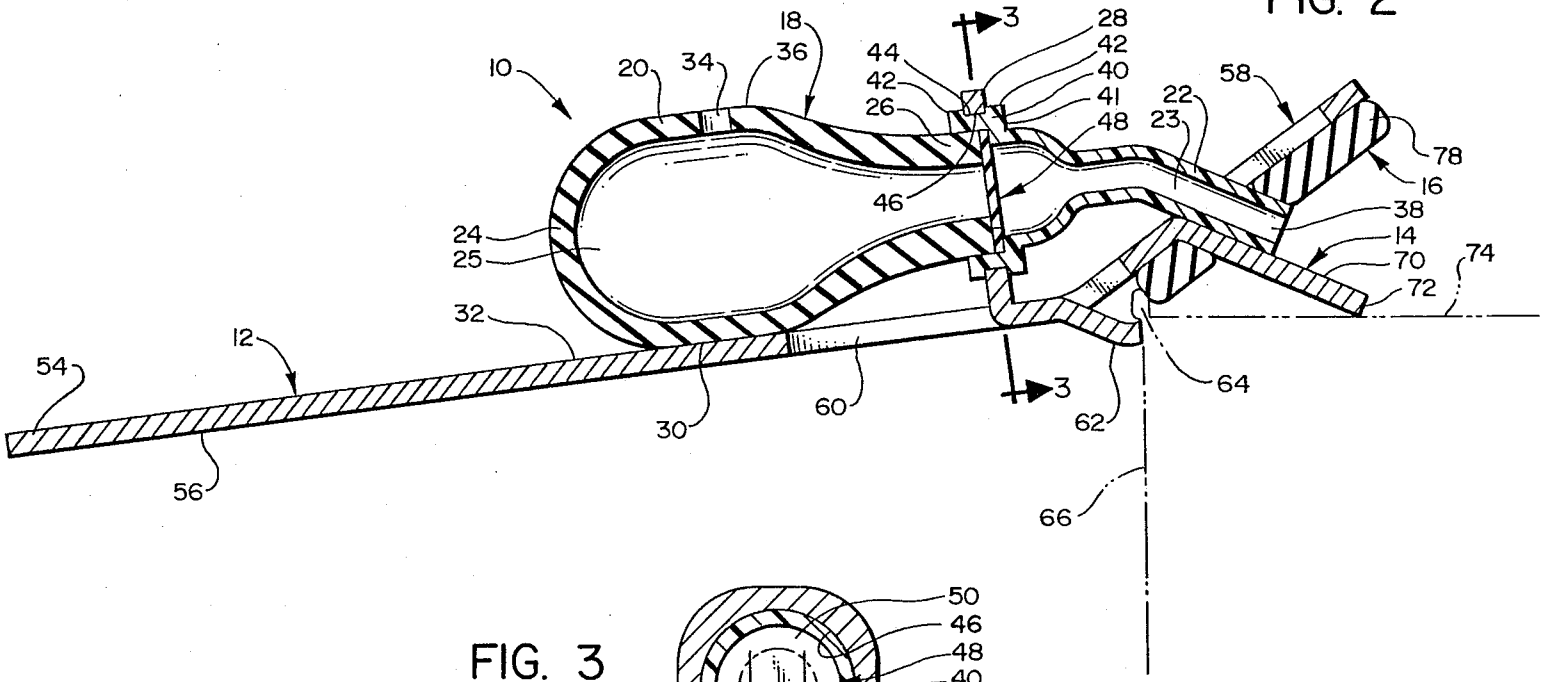
FIG. 2 is a side sectional view taken along a vertical plane passing through the longitudinal center line as the invention is about to make an opening in a can.

To describe the operation of the present invention, let it be assumed that the device 10 is to be used to empty the contents of a can, such as a can containing frozen orange juice. The top lid of the orange juice can is opened in a conventional manner, and then the can 66 is turned upside down. The device 10 is positioned as shown in FIG. 2, with the finger 62 engaging the lip 64, and the apex end 72 of the cutting member 70 positioned against the bottom lid or plate 74 of the can 66.

Figures 4, 5:
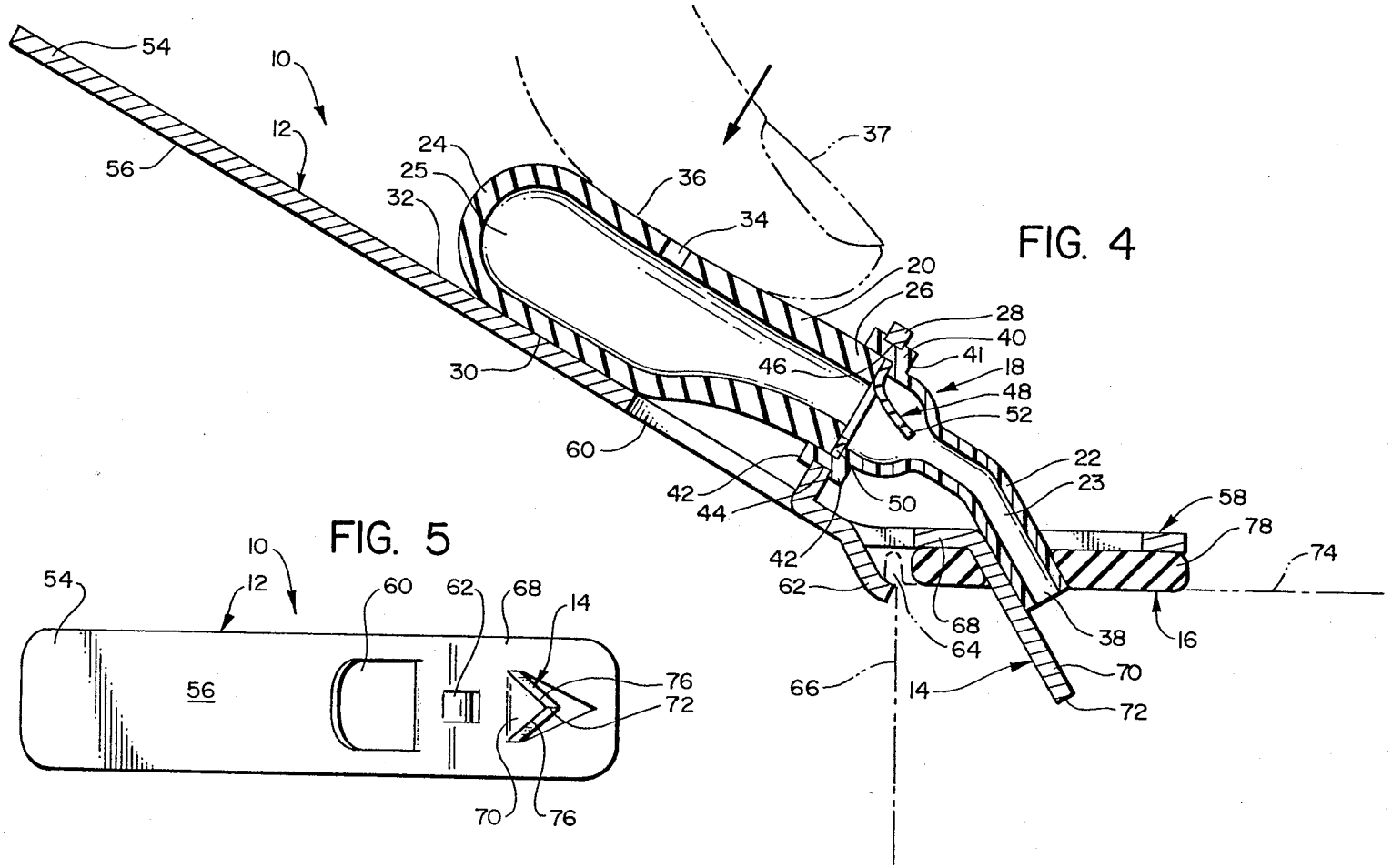
FIG. 4 is a side sectional view taken along a vertical plane passing through the longitudinal center line as the invention is in use.
FIG. 5 is a bottom plan view of a portion of the present invention, this being an integral member that forms the handle, the opening means, and a base plate portion for the sealing means. The sealing means is for purposes of illustration, not shown in FIG. 5.

The person then lifts the handle 10 in the same motion that a conventional beverage can opener is manipulated, causing the cutting member 70 to form an opening in the can bottom lid 74. The natural follow through motion of lifting the handle 12 causes the sealing portion 78 of the sealing means 16 to become pressed downwardly on the exposed surface of the bottom lid 74. At this point, the device is held in that position (as shown in FIG. 4) where the opening formed by the cutting member 70 remains sealed.

As indicated previously, the squeeze bulb 20 is positioned, relative to the handle 12, so that when the person grasps the handle 12 in the fingers of the hand, the thumb 37 becomes positioned over the opening 34 in the squeeze bulb 20. Thus, with the sealing means 16 sealing off the opening formed in the bottom lid 74, the person places the thumb so as to close the opening 34 and then moves the thumb downwardly to depress the squeeze bulb 20 and force the air out of the chamber 25 and through the conduit 22 and into the interior of the can 66. As a person releases the thumb from the bulb 20, the resiliency of the material of the bulb 20 causes the bulb 20 to expand to its original position and draw in more air through the opening 34. The check valve 48 prevents any return of the air from the interior of the can 66 through the air passageway 23 of the conduit 22. Then the person again depresses the squeeze bulb 20, while keeping the opening 34 closed. This process is repeated until a sufficient volume of air at an adequate pressure is developed within the bottom portion of the can 66 so that the material in the can is fully ejected from the can 66.

It is to be understood that various modifications could be made to the present invention without departing from the basic teachings thereof.

I claim:

1. An apparatus to remove contents from a container having a first open portion, a peripheral wall portion and an end wall portion at least partially enclosing the contents, the apparatus comprising:

(a) a handle having a rear end and a front operating end, the handle being arranged to be grasped and rotated manually, said handle having a locating member adapted to engage the can at a pivot location adjacent to said end wall portion;

(b) an opening means located at the front end of the handle spaced from said locating member and arranged to be located adjacent to the end wall portion in a first operating position preparatory to forming an opening in the wall portion, and further arranged to be moved by rotation of the handle along a handle operating path to a second operating position where the opening is formed in the end wall portion;

(c) an opening air sealing means mounted at the front end of the handle and arranged to be moved into sealing engagement with the end wall portion at a sealing position by rotation of the handle along the handle operating path to enclose the opening; and (d) a manually operable air pressurizing means mounted on said apparatus to inject air through the air sealing means and through the opening formed in the end wall portion to pressurize the interior area of the can.

2. The apparatus as recited in claim 1, wherein the opening member is positioned at a first lower position forwardly of the pivot location, and the opening air sealing means is positioned at a second upper position spaced upwardly from the opening member, whereby manipulation of the handle along the handle operating path first causes the opening member to form the opening in the wall means, while further movement of the handle along the operating path moves the sealing means downwardly into the sealing engagement.

3. The apparatus as recited in claim 1, wherein the air pressurizing means comprises a squeeze bulb means mounted to the handle so as to be manually operated, and an air conduit which leads from the squeeze bulb means through the air sealing means and from which air can be injected into the container.

4. the apparatus as recited in claim 3, wherein the squeeze bulb means is positioned above the handle so as to be positioned to be squeezed downwardly manually to move air into the conduit.

5. The apparatus as recited in claim 4, wherein the squeeze bulb means is positioned at a forward location on the handle and positioned so as to be manually depressed by a thumb of a person's hand, where the hand is grasping the handle so as to manipulate the same.

6. The apparatus as recited in claim 5, wherein the squeeze bulb means has an upper through opening adapted to be engaged by the thumb so as to close the opening, thus permitting the squeeze bulb means to be depressed by the thumb and cause air to be moved from the squeeze bulb and through the conduit.

7. A method of manipulating an apparatus to remove contents from a container having a first open portion, a peripheral wall portion and an end wall portion at least partially enclosing the contents, said method comprising:

(a) providing an apparatus comprising:

i. a handle having a rear end and a front operating end, the handle being arranged to be grasped and rotated manually, said handle having a locating member adapted to engage the can at a pivot location located adjacent to said end wall, ii. an opening means located at the front end of the handle spaced from said locating member and arranged to be located adjacent to the end wall portion in a first operating position preparatory to form an opening in the wall portion, iii. an opening air sealing means mounted at the front end of the handle, iv. a manually operable air pressurizing means mounted on said apparatus, (b) locating said handle in a manner that the locating member engages the can at said pivot location;

(c) rotating said handle along a handle operating path to a second operating position where the opening is formed in the end wall portion and moving the sealing means into sealing engagement with the end wall portion at a sealing position of the handle; and (d) manually operating said air pressurizing means to inject air through the air sealing means and through the opening formed in the end wall portion to pressurizing an interior area of the can.

8. The method as recited in claim 7, wherein the handle is rotated along the handle operating path first to cause the opening member to form the opening in the wall means and further movement of the handle along the operating path moves the sealing means downwardly into sealing engagement.

9. The method as recited in claim 7, wherein the air pressuriziing means comprises a squeeze bulb mounted to the handle so as to be manually operated, and an air conduit which leads from the squeeze bulb means to the air sealing means, said method further comprising operating said squeeze bulb to inject air through the air conduit and into the container.

10. The method as recited in claim 9, wherein the squeeze bulb means is positioned above the handle, said method further comprising squeezing said squeeze bulb downwardly to move air into the conduit.

11. The method as recited in claim 10, wherein the squeeze bulb means is positioned at a forward location on the handle, said method further comprising manually depressing said squeeze bulb means by a thumb of person's hand, and grasping the handle by the hand.

12. The method as recited in claim 11, wherein the squeeze bulb means has an upper through opening, said method further comprising engaging said upper through opening by the thumb so as to close the opening, and then depressing the thumb to cause air to be moved from the squeeze bulb and through the conduit.

* * * * *